US008359681B2

(12) United States Patent
Hotaling

(10) Patent No.: US 8,359,681 B2
(45) Date of Patent: Jan. 29, 2013

(54) POOL SAFETY COVER

(75) Inventor: Robert A. Hotaling, East York, PA (US)

(73) Assignee: International Vectors Ltd., Emigsville, PA (US)

( * ) Notice: Subject to any disclaimer, the term of this patent is extended or adjusted under 35 U.S.C. 154(b) by 0 days.

(21) Appl. No.: 13/136,964

(22) Filed: Aug. 16, 2011

(65) Prior Publication Data

US 2012/0073039 A1 Mar. 29, 2012

Related U.S. Application Data

(60) Provisional application No. 61/404,233, filed on Sep. 29, 2010.

(51) Int. Cl.
*E04H 4/00* (2006.01)

(52) U.S. Cl. ..... 4/498

(58) Field of Classification Search ..... 4/498, 496, 4/499–503
See application file for complete search history.

(56) References Cited

U.S. PATENT DOCUMENTS

| | | | | | |
|---|---|---|---|---|---|
| 3,534,412 | A | * | 10/1970 | Crook | 4/503 |
| 3,676,880 | A | * | 7/1972 | Kwake | 4/499 |
| 3,780,385 | A | * | 12/1973 | Dunn | 4/501 |
| 3,927,427 | A | * | 12/1975 | Aine | 4/499 |
| 4,064,571 | A | | 12/1977 | Phipps | |
| 4,236,258 | A | * | 12/1980 | Batstone | 4/501 |
| 4,246,663 | A | * | 1/1981 | Aragona et al. | 4/500 |
| 4,251,889 | A | * | 2/1981 | Lof | 4/498 |
| 4,257,132 | A | * | 3/1981 | Kerby | 4/498 |
| 4,459,711 | A | * | 7/1984 | Sartain et al. | 4/502 |
| 4,601,072 | A | * | 7/1986 | Aine | 4/499 |
| 5,022,101 | A | * | 6/1991 | Gosselin et al. | 4/498 |
| 5,025,513 | A | * | 6/1991 | Weissner | 4/498 |
| 5,068,929 | A | * | 12/1991 | Weiner | 4/503 |
| 5,259,078 | A | * | 11/1993 | Crandall | 4/503 |
| 5,425,143 | A | * | 6/1995 | Kalandovsky | 4/502 |
| 5,546,615 | A | * | 8/1996 | Chamness | 4/503 |
| 5,555,877 | A | * | 9/1996 | Lockwood et al. | 126/565 |
| 5,722,098 | A | * | 3/1998 | Stern | 4/498 |
| 5,740,562 | A | * | 4/1998 | Nickalo | 4/504 |
| 6,014,778 | A | * | 1/2000 | Varnado | 4/502 |
| 6,286,155 | B1 | * | 9/2001 | Handwerker | 4/498 |
| 6,286,156 | B1 | * | 9/2001 | Sullivan | 4/498 |
| 6,357,964 | B1 | * | 3/2002 | DeGarie | 405/52 |
| 6,497,533 | B2 | * | 12/2002 | DeGarie | 405/52 |
| 6,606,752 | B2 | * | 8/2003 | Marbach | 4/500 |
| 6,662,383 | B2 | | 12/2003 | Cornelius et al. | |
| 6,691,334 | B2 | * | 2/2004 | St-Hilaire | 4/498 |
| 6,836,907 | B1 | * | 1/2005 | Pesta | 4/498 |
| 7,707,662 | B2 | * | 5/2010 | Pesta | 4/498 |
| 7,712,160 | B2 | * | 5/2010 | Pesta | 4/498 |
| 7,735,163 | B2 | * | 6/2010 | Comitino et al. | 4/503 |
| 7,805,779 | B2 | * | 10/2010 | Esson | 4/502 |
| 2005/0262626 | A1 | * | 12/2005 | Lewis | 4/498 |
| 2010/0235979 | A1 | | 9/2010 | Pesta | |

* cited by examiner

*Primary Examiner* — Lori Baker
(74) *Attorney, Agent, or Firm* — Stuart J. Friedman

(57) ABSTRACT

A swimming pool safety cover of the solid fabric variety includes a flexible cover fabric formed of a plurality of reinforced thermoplastic polymer pieces assembled and heat sealed along their edges to form a unitary cover conforming to the shape of the pool and a plurality of anchor straps, each strap extending along a portion of and heat sealed to one side of the cover and projecting outwardly from, and spaced apart along, the periphery of the cover. The projecting portion of each anchor strap is sufficiently long to attach to the hardware and the portion of each strap extending along and heat sealed to the cover is no longer than one to three times the length of the projecting portion.

12 Claims, 4 Drawing Sheets

POOL SAFETY COVER

CROSS-REFERENCE TO RELATED APPLICATIONS

This is a non-provisional application based upon U.S. provisional application Ser. No. 61/404,233, filed Sep. 29, 2010.

FIELD OF THE INVENTION

The present invention relates to safety covers for swimming pools and, more particularly, to a pool safety cover which is particularly strong, durable and light weight due to its completely heat sealed construction, its elimination of crisscrossed webbing straps stitched to the cover fabric and its complete elimination of all stitching, which avoids dry rot and deterioration.

BACKGROUND OF THE INVENTION

Drowning is one of the leading causes of death for children age 14 and under and 75 percent of children involved in swimming pool accidents are between 1 and 3 years old. One of the most important safety devices for any swimming pool is a pool safety cover to prevent harm to small children and animals venturing into a swimming pool area by inhibiting their access to the water in the pool. Standard performance specifications for pool safety covers are set forth in ASTM F 1346-91 and are intended to reduce the risk of drowning by a child under five years of age. In this regard, pool safety covers are very different from pool liners which merely line the floor and/or walls of the interior of the pool and pool covers whose primary purpose is to prevent debris from entering the pool and not to provide a high level of safety for children under the age of five by inhibiting their access to the water.

Pool safety covers must meet rigorous strength and safety specifications. Thus, for pools having diameters greater than eight feet, the safety cover must be able to support the weight of two adults and a child, i.e., at least 485 pounds. In addition, the safety cover must be designed in such a way that if a child under the age of five were to fall onto the cover neither that child nor another child could slip through any openings that may occur between the safety cover and the side of the pool or gain access to the water. Still further, safety covers must either incorporate a drainage system or have an auxiliary system provided which will drain substantially all standing water from the cover within thirty minutes after cessation of normal rainfall. This is to prevent the formation of water puddles on the upper surface of the pool cover since these puddles can constitute a drowning hazard for small children under five years of age. Finally, a safety cover must be so constructed that any opening in the cover or between the cover edge and the deck surface or coping wall and the top surface of the pool is sufficiently small and strong to prevent the opening from being forced to a size that a small child's head could gain access to the water.

Historically, solid pool covers were made using light gauge polyvinyl chloride (PVC) and were held in place around the pool with weights, most typically water filled bags. These covers, while protecting the pool from debris entering the water during the non-swimming season, sagged, stretched, collected water and became a drowning hazard. Light weight mesh covers were developed to allow water to pass through to avoid puddling while maintaining most of the debris on top and out of the pool water. However, as debris collected on top of the mesh cover, it pressed the cover material into the water and contributed to the accumulation of dirt in the pool. Over time better materials became available but none of these early pool covers could truly be considered "safety" covers until reinforced vinyl and the use of tension straps came into use. There are currently two varieties of safety pool covers, mesh and solid. Both types are anchored to a pool decking with straps that are attached to the cover and which are used to pull the cover taut over the pool. The straps are usually attached to stainless steel compression springs and are coupled to recessed anchors embedded in the deck surface. When the cover is removed, deck anchors which are not already flush with the deck can be screwed down to prevent tripping or toe-stubbing. Mesh covers allow rain and snow to drain through the mesh, avoiding puddling; however, dirt and silt can pass through the webbing and dirty the pool water. Solid pool covers keep the pool free of dirt and silt; however, they are subject to puddling on the surface, necessitating the use of drain panels in the solid cover or small cover pumps to automatically pump accumulated water off the cover.

Referring to FIG. 1, conventional prior art safety pool covers are formed of either a strong mesh fabric or a solid non-porous fabric reinforced by attached webbing strips or straps which extend across the entire length and width of the cover in typically perpendicular crossing patterns across one or both sides of the fabric and extend outwardly from the perimeter of the cover. The cover is held taut over the water surface of a swimming pool by compression springs coupling the outwardly extending straps to anchors embedded in the deck surface surrounding the pool. These covers are normally suspended above the entire water surface and extend beyond the edge of the pool about 12 to 18 inches onto the surrounding deck surface so that, in compliance with ASTM F 1346-91, there are no openings providing access to the water through which children or animals can fall or become lodged. Likewise, in compliance with ASTM F 1346-91, the covers are designed to support the weight of two adults and a child without structural failure. Safety covers are preferably custom made for pools to assure proper fit, although ready made safety covers are often used for pools having conventional shapes and sizes, such as rectangular pools. Prior art safety covers are typically manufactured from sheets of mesh or solid fabric which are cut into appropriately sized pieces for a particular pool, e.g., 3'×3' or 5'×5' squares, and then stitched to the typically crisscrossed webbing straps to form a pool cover having the desired shape for covering the particular swimming pool. In all prior art pool safety covers the seams between pieces of fabric and the webbing straps are stitched using thread. It has been found, however, that stitching carries a high risk of failure especially over time as water, chemicals and weather conditions cause the webbing straps and stitching to dry rot or otherwise deteriorate and, ultimately, fail. Accordingly, there is a need for a pool safety cover which meets the specifications of ASTM F 1346-9, which is not subject to deterioration and failure due to water, chemical exposure and/or weather conditions and which does not exhibit the other disadvantages of conventional prior art pool safety covers.

SUMMARY OF THE INVENTION

It is, therefore, a primary object of the present invention to provide a novel and improved pool safety cover which meets all of the specifications of ASTM F 1346-9 yet which is economical and simple to manufacture and install.

It is also an object of the present invention to provide a novel and improved pool safety cover which is not subject to deterioration due to water, chemical exposure and/or weather conditions and, therefore, does not suffer from the high risk of failure associated with pool safety covers which utilize webbing straps stitched to the pool safety cover fabric.

It is another object of the present invention to provide a novel and improved pool safety cover which minimizes the number of seams needed to form the pool safety cover.

It is yet another object of the present invention to provide a novel and improved pool safety cover which minimizes the number of anchor straps needed to tautly hold the pool safety cover over the water surface of a swimming pool and, therefore, which minimizes the number of anchors embedded in the deck surface surrounding the pool.

It is still another object of the present invention to provide a novel and improved pool safety cover which is significantly lighter in weight than pool safety covers which include stitched webbing straps extending across the entire length and width of the cover in typically perpendicular crossing patterns on one or both sides of the cover.

The foregoing and other objects are achieved in accordance with the present invention by providing a swimming pool safety cover of the solid fabric variety comprising:

a flexible fabric cover configured to cover a swimming pool and adapted to be stretched tautly over and spaced from the water surface, said cover extending beyond the pool edge and including anchor straps extending beyond the cover edges for attachment to the surrounding pool decking;

said flexible cover fabric comprising a plurality of pieces of reinforced thermoplastic polymer shaped and dimensioned to fit together to conform to the shape of the pool perimeter and to extend beyond the pool edge, the edges of the pieces being heat sealed to the edges of adjacent pieces to form a unitary cover having a plurality of heat sealed seams;

a reinforcing strap heat sealed to one side of the cover around its entire periphery; and a plurality of anchor straps, each anchor strap extending along a portion of and heat sealed to one side of the cover and projecting outwardly from and spaced apart along the periphery of the cover for attachment to hardware attached to the surrounding pool decking, the projecting portion of each anchor strap being sufficiently long to attach to said hardware and the portion of each strap extending along and heat sealed to said cover being no longer than one to three times the length of the projecting portion.

In another aspect of the invention the reinforcing and anchor straps are a reinforced polyvinyl chloride comprising a scrim material impregnated with polyvinyl chloride and having a tensile strength of at least 3000 pounds.

In still another aspect of the invention each anchor strap includes an abrasion resistant thermoplastic polymer strip heat sealed to its underside to protect the strap and the cover from damage where they contact the coping or decking surrounding the edge of the pool.

In a preferred aspect of the invention the cover has an upper side intended to face the sky, and an underside intended to face the pool water, when the cover is installed on the pool, the reinforcing strap is heat sealed to the upper side of the cover around its entire periphery and the anchor straps extend along and are heat sealed to the underside of the cover.

DETAILED DESCRIPTION OF THE INVENTION

It has been found that pool safety covers which are assembled without stitching and which utilize heat sealing to assemble the fabric pieces and to attach the straps to the cover fabric are superior in durability to pool safety covers which employ stitching. In accordance with the pool safety cover of the present invention, the ends of seams between pieces of fabric are overlapped and then heat sealed to each other to form a unitary cover having a plurality of smooth, strong, attractive seams. By heat sealing or heat welding, as used herein, is meant the process of joining two or more thermoplastic films or sheets by heating areas in contact with each other to the temperature at which fusion occurs, usually aided by pressure. When the heat is applied by dies or rotating wheels maintained at constant temperature, the process is called thermal sealing. Another form of heat sealing or heat welding is impulse sealing, in which heat is applied by resistance elements which are applied to the work when relatively cool, then rapidly heated. Simultaneous sealing and cutting can be performed by this method. In accordance with the present invention, the preferred form of heat sealing or heat welding is dielectric sealing, which is accomplished by inducing heat within the films by means of radio frequency waves.

The fabric from which the pool safety cover is made is, desirably, a reinforced thermoplastic polymer, such as polyvinyl chloride. One particularly useful reinforced PVC is a scrim reinforced laminate which includes two PVC film layers overlying and adhesively bonded to a central scrim layer, which provides the reinforcement. Another type of reinforced PVC is a coated scrim in which the scrim material is submerged into liquid PVC, removed and allowed to solidify to impregnate the scrim. In accordance with the present invention, the fabric of the cover is desirably a three ply product consisting of a piece of scrim laminated between two sheets of polyvinyl chloride film. Particularly preferred fabric cover products are available from various manufacturers in standard widths ranging between about 48" and 75" and having a weight of from about 12 to 18 ounces per square yard. The straps are desirably formed from a reinforced PVC in which the scrim material is impregnated by submerging it in liquid PVC. Inasmuch as these straps support the cover tautly over the surface of the pool water and rainwater accumulating on the cover increases the load on the straps, the straps must be sufficiently strong to handle the anticipated loading. Desirably, the straps are at least 1/16" thick, at least 1" wide, have a weight of from about 1 to 4 oz/yd and exhibit a tensile strength of at least 3,000 pounds, preferably at least 4,000 pounds.

Figure 2:
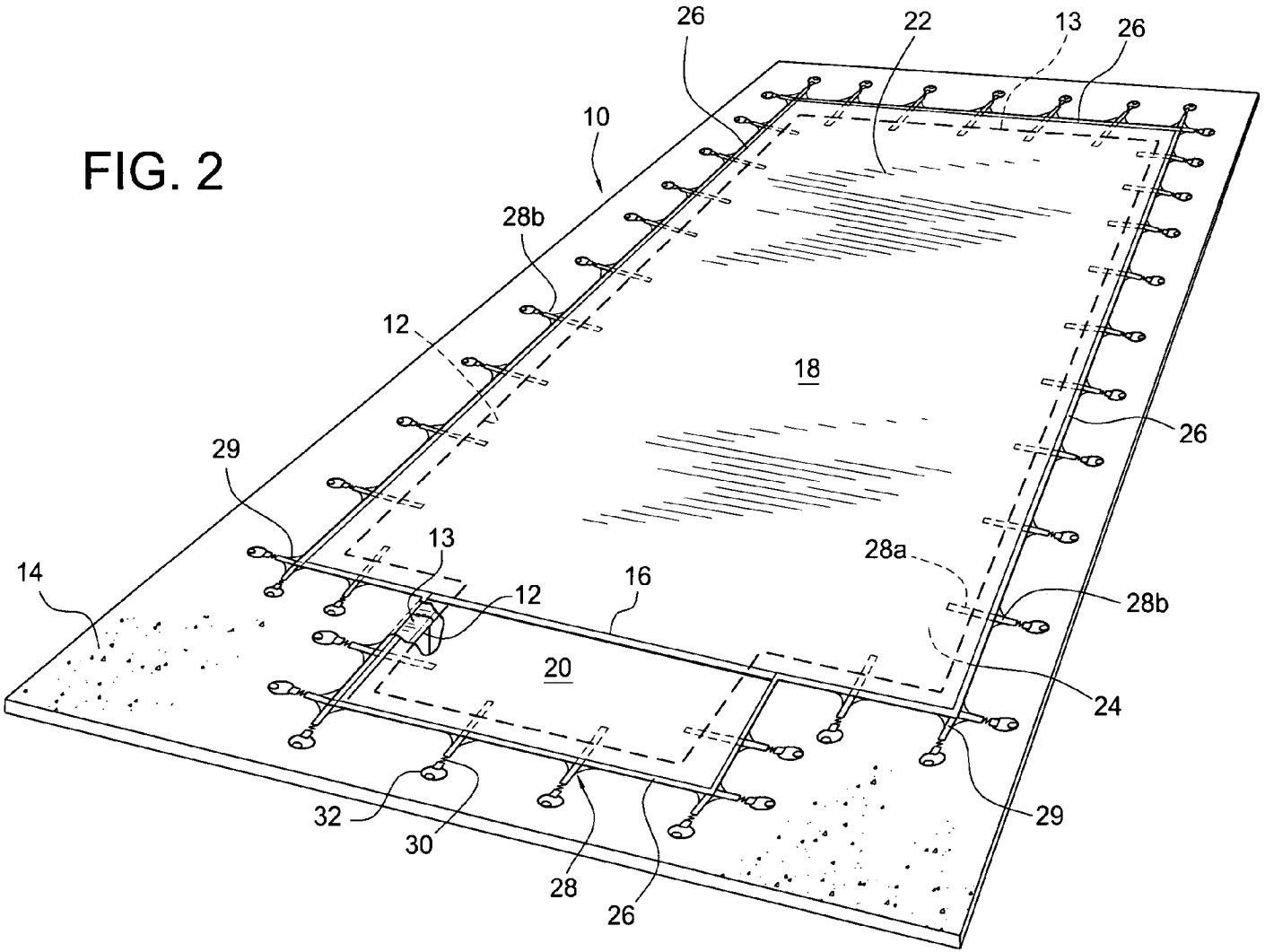
FIG. 2 is a top plan view of a pool safety cover of the present invention installed over a swimming pool.

Referring now to FIG. 2, a pool safety cover assembled in accordance with the present invention is shown at 10. Pool safety cover 10 is suspended above the entire water surface within pool edge 12 (shown in phantom) and extends beyond the edge 12 of the pool and beyond the pool's coping 13 about 15 inches onto the surrounding deck surface 14. Cover 10 is formed from appropriately sized pieces of reinforced PVC for a particular pool shape which are heat sealed together at their edges to form thermally welded seams desirably having about a ½" weld or greater. A typical weld is illustrated in FIG. 2 at 16 where larger rectangular piece 18 is joined to smaller rectangular piece 20. Cover 10 has an upper side 22 intended to face the sky when the cover is in place on the pool and an underside 24 intended to face the pool water when the cover is in place on the pool. The edge of the upper side 22 of cover 10 is heat sealed to an approximately 1" wide peripheral reinforcing strap 26 around its entire periphery. In addition, a plurality of about 1" wide anchor straps 28 are thermally welded to the underside 24 of cover 10 at spaced apart intervals, generally not more than 4' apart, around the cover's periphery in such a manner that each anchor strap 28 has a portion 28*a* extending along the underside 24 of cover 10 (see FIG. 3) and a portion 28*b* projecting outwardly from the cover's periphery. Additionally, corner anchor straps 29 are heat sealed to peripheral anchor strap 26 at each external corner of cover 10 and extend outwardly therefrom on the upper side 22 of cover 10. Generally, the projecting portion 28*b* of strap 28 is sufficiently long to attach to the decking hardware and the cover attached portion 28*a* of strap 28 is no longer than one to three times the length of projecting portion 28*b*, depending upon the dimensions of the pool. Desirably, the cover attached portion 28*a* is two to three times the length of the projecting portion 28*b* to assure strong adherence to the fabric of cover 10. In a preferred embodiment of the invention, portion 28*a* of strap 28 extends about 33" along the underside 24 of cover 10 and portion 28*b* projects about 15" outwardly from the cover's periphery. Anchor straps 28*b* are intended to attach to stainless steel compression springs 30 which are coupled to hardware, such as recessed anchors 32, embedded in the surface of deck 14 in conventional manner. Straps 26, 28 and 29 can be heat sealed to either the upper side 22 or underside 24 of cover 10, it being believed that the preferred arrangement described above is most aesthetically pleasing to the pool owner.

Figure 3:
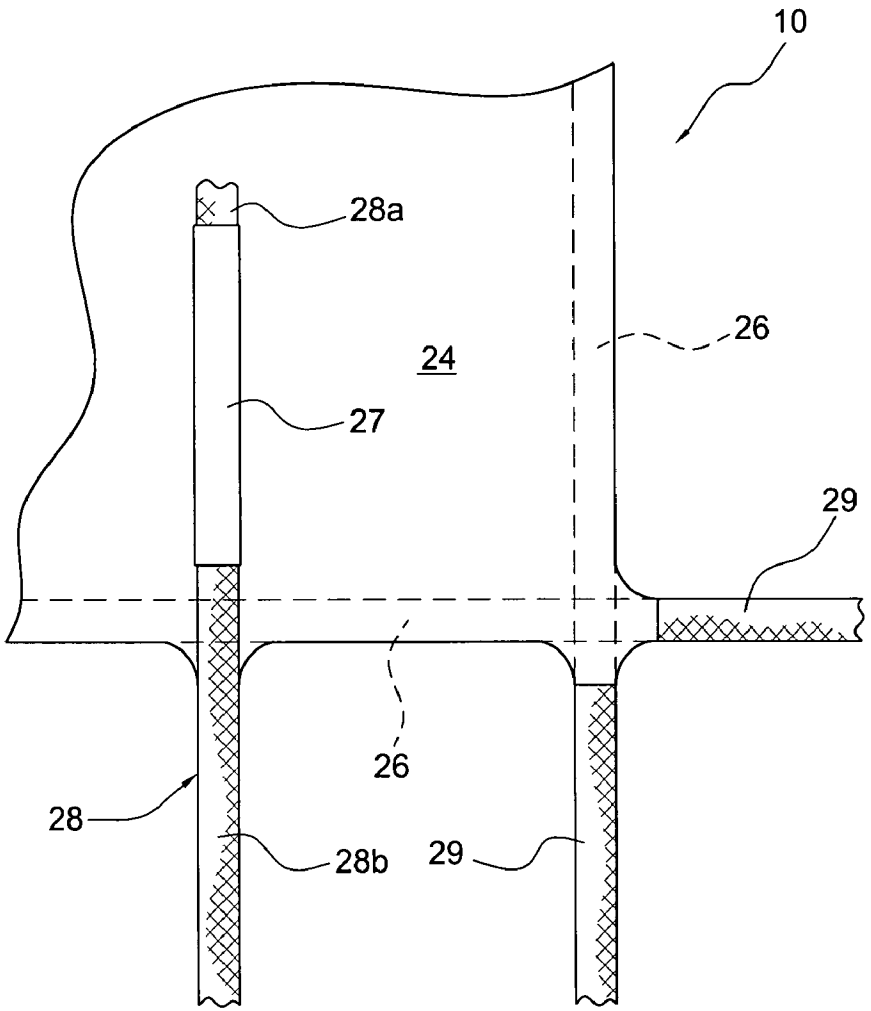
FIG. 3 is a bottom plan view of a corner section of the improved pool safety cover of FIG. 2 showing the manner in which underside straps are attached to the cover.

Referring to FIG. 3, it can be seen that each anchor strap 28 desirably includes a strip 27 of abrasion resistant thermoplastic polymer material heat sealed to its underside at the location along its length where it rests upon the coping 13 or decking 14 surrounding the pool edge to protect the strap 28 and the cover 10 from rough edges which could damage the straps or the cover. Desirably the strap reinforcing strip is formed of extruded flexible PVC material and is about 12"-15" in length, ⅜" wide and has a thickness of 3/16".

The pool safety cover of the present invention is of the solid variety. As is well known, solid pool covers keep the pool free of dirt and silt; however, they are subject to puddling as rain water accumulates on its surface. To deal with this puddling, a fully automated cover pump is available with every solid safety cover. Such a pump is fully automated, including a rain water accumulation sensor for automatically turning the pump on and off. One suitable type of automated cover pump is the Rule 1800 cover pump, an electrically operated, automatic submersible pool cover pump which includes a strainer base for filtering out leaves and debris and is capable of an 1,800 gallons/hour flow rate. Alternatively, a mesh drain panel can be heat welded anywhere in the body of the cover if the use of a pool cover pump is not desirable or practical.

Figure 1:
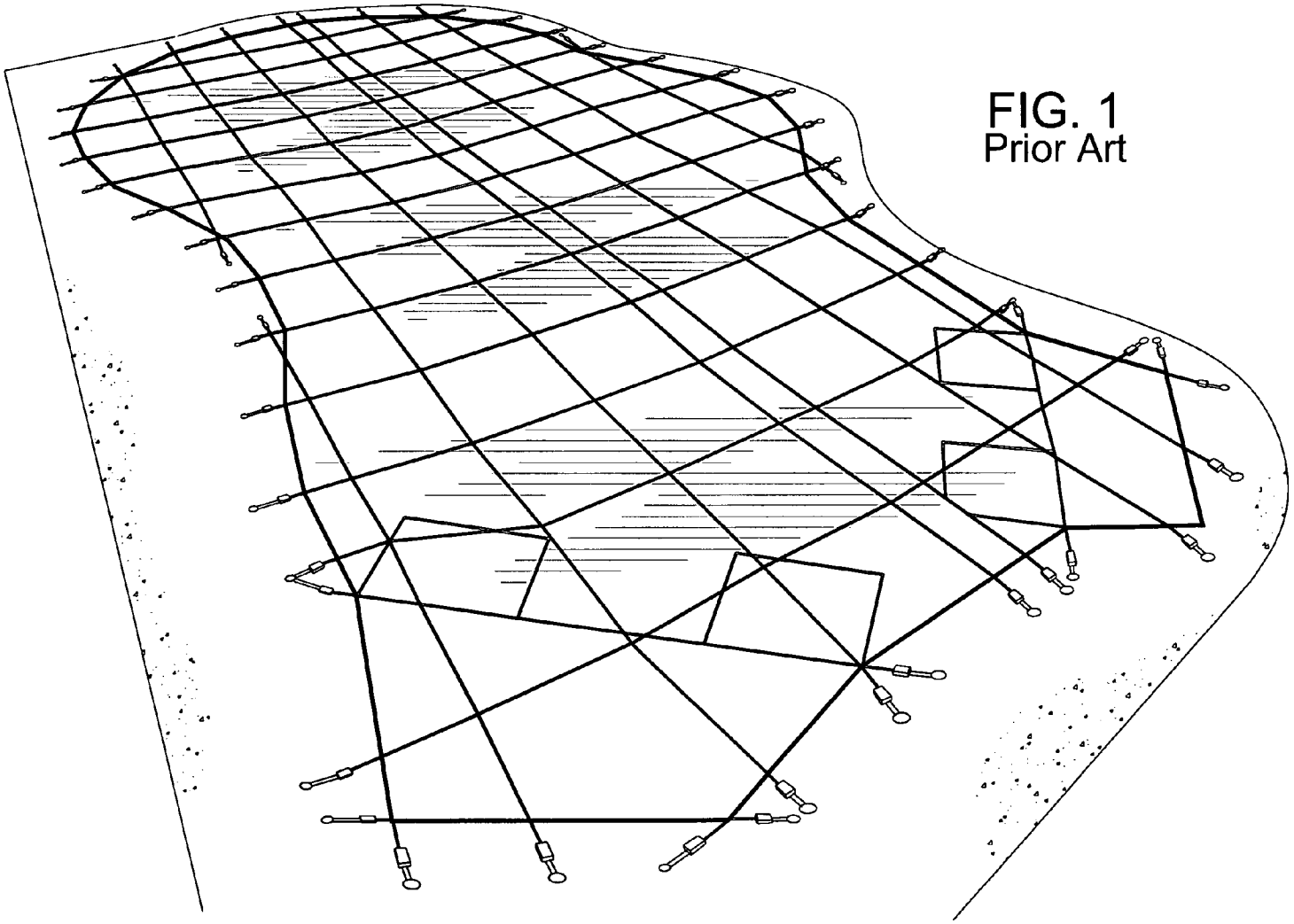
FIG. 1 Prior Art
FIG. 1 is a top plan view of a prior art pool safety cover installed over a swimming pool, illustrating webbing straps stitched onto the pool cover in a predetermined geometric pattern.
Figure 4:
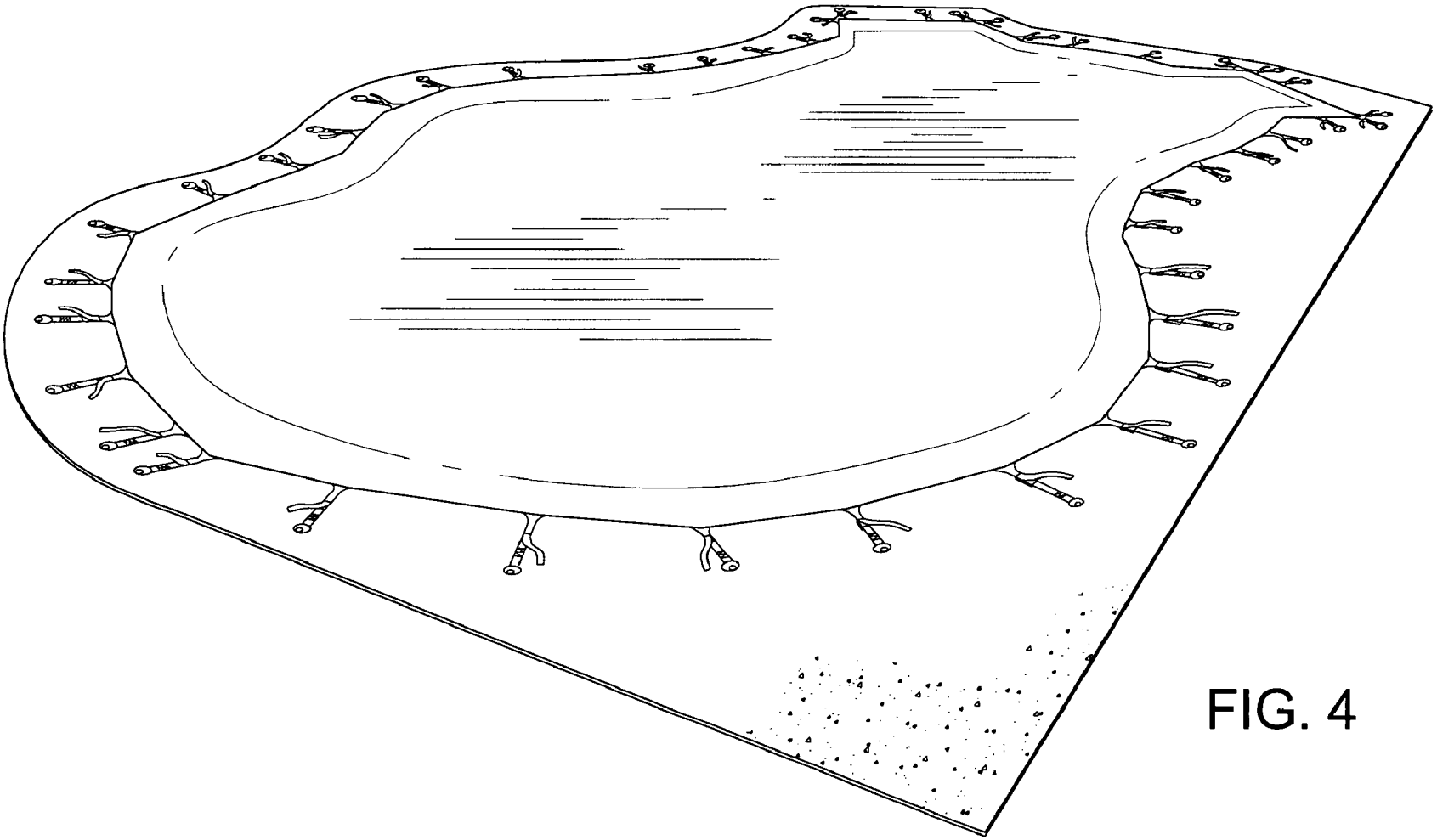
FIG. 4 is a top plan view of the pool safety cover of the present invention installed over the very same pool as in FIG. 1.

Pool safety cover 10 of the present invention is particularly advantageous compared to prior art pool safety covers which are typically manufactured from sheets of mesh or solid fabric cut into appropriately sized pieces for a particular pool and then stitched using thread to the typically crisscrossed webbing straps to form a pool cover having the desired shape for covering the particular swimming pool. Compare, for example, the prior art pool safety cover of FIG. 1 and the pool safety cover of the present invention in FIG. 4, which are shown covering the very same pool. One major advantage is that pool safety cover 10 is 100% heat welded, including the straps, and, therefore, the problem of stitching failure over time is avoided as water, chemicals and weather conditions cause the webbing straps and stitching of prior art safety covers to dry rot or otherwise deteriorate and fail. Another advantage is that pool safety cover 10 includes far fewer seams than prior art pool safety covers, which are limited to 3'×3' or 5'×5' squares sewn together and stitched to criss-crossed webbing straps, and is therefore more economical and simpler to manufacture. Moreover, pool safety cover 10 has the flexibility to heat weld a strap anywhere around the perimeter of the cover, or leave out a strap anywhere around the perimeter of the cover, depending upon the freeform shape of the pool, and is not restricted to the predetermined geometrical pattern of prior art safety covers using stitched straps. As a consequence, on freeform pools, the pool safety cover 10 requires approximately 10% to 15% fewer springs and deck anchors than prior art pool safety covers. Of particular importance is that the weight of pool safety cover 10 is approximately 35% to 40% lighter, depending upon the cover size, than correspondingly sized prior art solid safety covers due to the elimination of the heavy straps that are stitched crisscrossing the length and width of prior art safety covers. This makes handling, shipping and installing pool safety cover 10 simpler and more economical.

The invention claimed is:

1. A swimming pool safety cover of the solid fabric variety comprising:

a flexible fabric cover configured to cover a swimming pool and adapted to be stretched tautly over and spaced from the water surface, said cover extending beyond the pool edge and including a plurality of anchor straps extending beyond the cover edges for attachment to the surrounding pool decking;

said flexible cover fabric comprising a plurality of pieces of reinforced thermoplastic polymer shaped and dimensioned to fit together to conform to the shape of the pool perimeter and to extend beyond the pool edge, the edges of the pieces being heat sealed to the edges of adjacent pieces to form a unitary cover having a plurality of heat sealed seams; and each anchor strap of said plurality of anchor straps extending along a portion of and heat sealed to one side of the cover and projecting outwardly from and spaced apart along the periphery of the cover for attachment to hardware attached to the surrounding pool decking, the projecting portion of each anchor strap being sufficiently long to attach to said hardware and the portion of each strap extending along and heat sealed to said cover being no longer than one to three times the length of the projecting portion, said cover being free of support straps extending from one edge to an opposite edge of said cover.

2. A swimming pool safety cover, as claimed in claim 1, wherein the length of the portion of each anchor strap extending along and heat sealed to said cover being no longer than two to three times the length of the projecting portion.

3. A swimming pool safety cover, as claimed in claim 1, wherein the anchor straps are a reinforced polyvinyl chloride comprising a scrim material impregnated with polyvinyl chloride and having a tensile strength of at least 3000 pounds.

4. A swimming pool safety cover, as claimed in claim 3, wherein the straps have a tensile strength of at least 4000 pounds.

5. A swimming pool safety cover, as claimed in claim 1, further including a reinforcing strap heat sealed to one side of the cover around its entire periphery.

6. A swimming pool safety cover, as claimed in claim 5, wherein the reinforcing strap is a reinforced polyvinyl chloride comprising a scrim material impregnated with polyvinyl chloride and having a tensile strength of at least 3000 pounds.

7. A swimming pool safety cover, as claimed in claim 5, wherein said cover has an upper side intended to face the sky when the cover is installed on the pool and an underside intended to face the pool water when the cover is installed on the pool, said reinforcing strap is heat sealed to the upper side of said cover around its entire periphery and said anchor straps extend along and are heat sealed to the underside of said cover.

8. A swimming pool safety cover, as claimed in claim 1, wherein said anchor straps are spaced apart around the periphery of said cover at intervals of not more than four feet.

9. A swimming pool safety cover, as claimed in claim 1, further including a mesh drain panel heat sealed within the periphery of said cover.

10. A swimming pool safety cover, as claimed in claim 1, wherein said flexible cover fabric is scrim reinforced polyvinyl chloride comprising a scrim laminated between sheets of polyvinyl chloride.

11. A swimming pool safety cover, as claimed in claim 1, for covering a swimming pool having a coping or decking surrounding the pool edge, wherein each said anchor strap includes a strip of thermoplastic polymer abrasion resistant material heat sealed to the underside thereof where the anchor strap contacts said coping or decking.

12. A swimming pool safety cover, as claimed in claim 11, wherein said strips heat sealed to said anchor straps are an extruded flexible polyvinyl chloride material.

* * * * *